US009889647B2

(12) United States Patent
McClelland

(10) Patent No.: US 9,889,647 B2
(45) Date of Patent: Feb. 13, 2018

(54) INTERDIGITATED PRIMITIVES

(71) Applicant: HEWLETT-PACKARD DEVELOPMENT COMPANY, L.P., Houston, TX (US)

(72) Inventor: Sean P. McClelland, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/114,958

(22) PCT Filed: Jan. 31, 2014

(86) PCT No.: PCT/US2014/014109
§ 371 (c)(1),
(2) Date: Jul. 28, 2016

(87) PCT Pub. No.: WO2015/116154
PCT Pub. Date: Aug. 6, 2015

(65) Prior Publication Data

US 2016/0355010 A1 Dec. 8, 2016

(51) Int. Cl.
*B41J 29/38* (2006.01)
*B41J 2/045* (2006.01)

(52) U.S. Cl.
CPC ..... *B41J 2/04588* (2013.01); *B41J 2/0458* (2013.01); *B41J 2/04543* (2013.01); *B41J 2/04586* (2013.01); *B41J 2/04545* (2013.01); *B41J 2/04573* (2013.01)

(58) Field of Classification Search
CPC .. B41J 2/0458; B41J 2/04543; B41J 2/04541; B41J 2/04586; B41J 2/04573; B41J 2/04588; B41J 2/04545
USPC ..... 347/12, 40, 47, 50, 58, 180
See application file for complete search history.

(56) References Cited

U.S. PATENT DOCUMENTS

| | | | | |
|---|---|---|---|---|
| 5,638,101 | A * | 6/1997 | Keefe | B41J 2/17553 347/58 |
| 5,907,337 | A | 5/1999 | Tajika et al. | |
| 6,183,078 | B1 | 2/2001 | Pietrzyk et al. | |
| 6,217,147 | B1 | 4/2001 | Holstun | |
| 6,431,686 | B2 | 8/2002 | Saul et al. | |
| 6,491,377 | B1 | 12/2002 | Cleland et al. | |
| 6,543,879 | B1 | 4/2003 | Feinn et al. | |
| 6,705,694 | B1 * | 3/2004 | Barbour | B41J 2/04506 347/19 |

(Continued)

FOREIGN PATENT DOCUMENTS

| | | |
|---|---|---|
| CN | 1796123 | 7/2006 |
| CN | 101274513 | 10/2008 |

(Continued)

OTHER PUBLICATIONS

Huston W. Rice; Next-generation Inkjet Printhead Drive Electronics; Hewlett-Packard Journal; Article 5; Jun. 1997; pp. 9-14.

*Primary Examiner* — Jannelle M Lebron
(74) *Attorney, Agent, or Firm* — Brooks, Cameron & Huebsch, PLLC

(57) ABSTRACT

Printing devices and methods are described. An array of ink nozzles can be arranged in a number of primitives, wherein a first primitive of the number of primitives is interdigitated with a second primitive.

8 Claims, 3 Drawing Sheets

(56) References Cited

U.S. PATENT DOCUMENTS

| | | | |
|---|---|---|---|
| 6,902,252 | B1 | 6/2005 | Torgerson et al. |
| 6,932,453 | B2 | 8/2005 | Feinn et al. |
| 2001/0012032 | A1 | 8/2001 | Kawamura et al. |
| 2003/0001913 | A1 | 1/2003 | Giere et al. |
| 2005/0231540 | A1 | 10/2005 | Benjamin et al. |
| 2006/0023012 | A1 | 2/2006 | Han et al. |
| 2006/0181558 | A1 | 8/2006 | Walmsley et al. |
| 2009/0033695 | A1 | 2/2009 | Burton |

FOREIGN PATENT DOCUMENTS

| | | |
|---|---|---|
| EP | 0705695 | 4/1996 |
| WO | 2013115804 | 8/2013 |

* cited by examiner

INTERDIGITATED PRIMITIVES

BACKGROUND

Printing devices are widely used and may include a printhead enabling formation of text or images on a print medium. Such a printhead may be included in a printer cartridge that includes channels that carry ink to firing chambers. For instance, ink may be ejected onto the print medium by being fired through a firing chamber from an ink supply.

DETAILED DESCRIPTION

A printer can use a printer cartridge (e.g., an inkjet printer cartridge) to dispense ink. A printer cartridge can include a nozzle member including nozzles (e.g., nozzle orifices). The nozzles can release and/or eject ink using firing chambers. The location of a nozzle can be an address. An address can be a location of a nozzle in a primitive and/or on a nozzle member in general. A number of addresses can be grouped into a primitive. A primitive can be a particular number of addresses (e.g., six addresses) to eject ink. The firing chambers can be associated with an address and eject ink. The firing chambers can be fired in a particular order. As the firing of each firing chamber increases, a reduction in addresses per primitive can occur. For example, eight addresses per primitive can operate at a lower frequency (e.g., fluidic frequency below 48 KHz and electrical frequency below 96 KHz) than six addresses per primitive (e.g., fluidic frequency of 48 KHz and electrical frequency at 96 KHz). Lowering a number of addresses per primitive can cause cross-talk. Cross-talk can include neighboring nozzles firing close together. Firing neighboring nozzles can cause puddling when ink is fired from firing chambers that are too close together.

Figure 2:
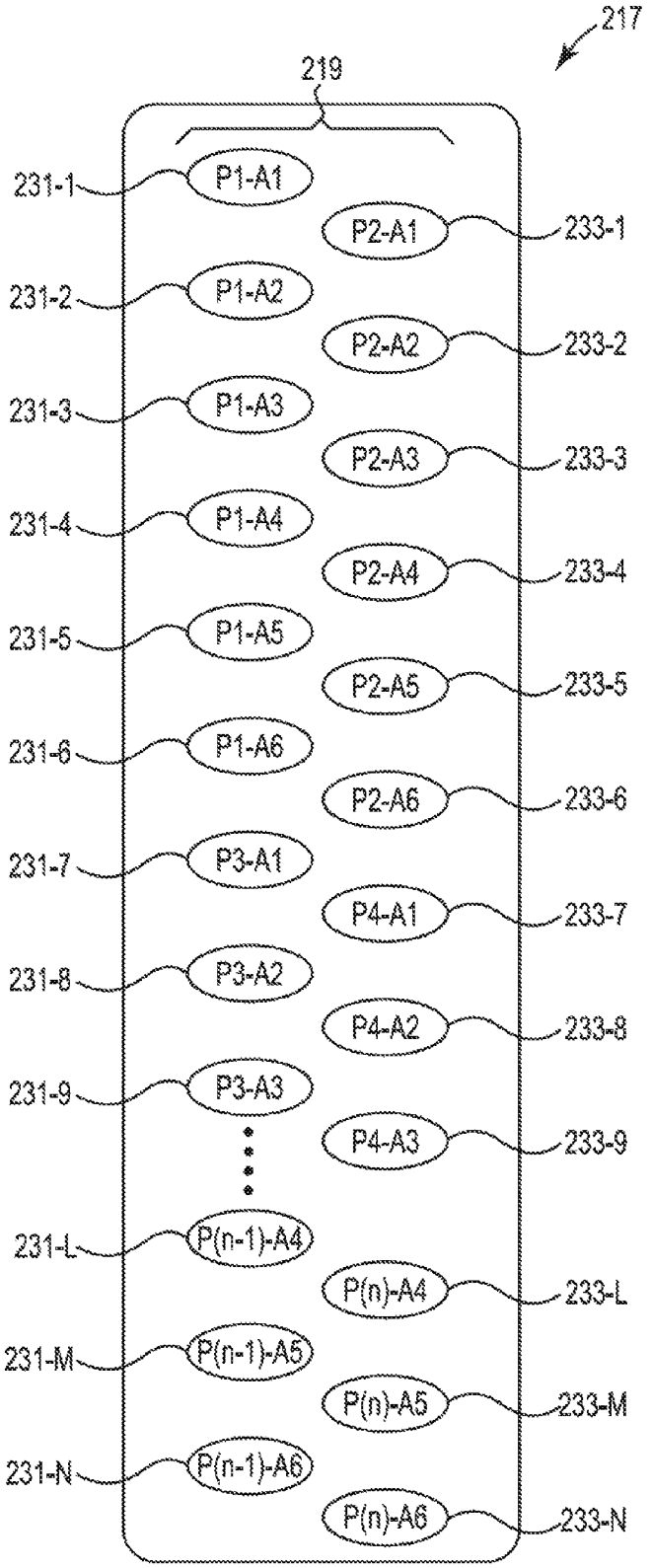
FIG. 2 is an illustration of an example of a nozzle member according to the present disclosure.

Cross-talk and electrical frequency can be related. As electrical frequency increases, a number of address per primitive may decrease. As the number of primitives decreases, cross-talk can increase. Interdigitating the addresses of a number of primitives (e.g., two primitives) can reduce cross-talk. Interdigitation can include interlocking two primitives. For example, non-interdigitated primitives can include an ordered series of nozzles identified as a first address (A1) of a first primitive (P1) (e.g., P1-A1), and subsequent address of the first primitive: P1-A2, P1-A3, P1-A4, P1-A5, P1-A6, and a first address of a second primitive (e.g., P2-A1), and subsequent addresses of the second primitive: P2-A2, P2-A3, P2-A4, P2-AS, and P2-A6. Interdigitated primitives can include an ordered series of nozzles identified as P1-A1, P2-A1, P1-A2, P2-A2, P1-A3, P2-A3, P1-A4, P2-A4, P1-A5, P2-A5, P1-A6, and P2-A6 (as illustrated in FIG. 2). Firing every other primitive in separate time series pulse propagations down a resistor column of nozzles can decrease cross-talk.

Figure 1:
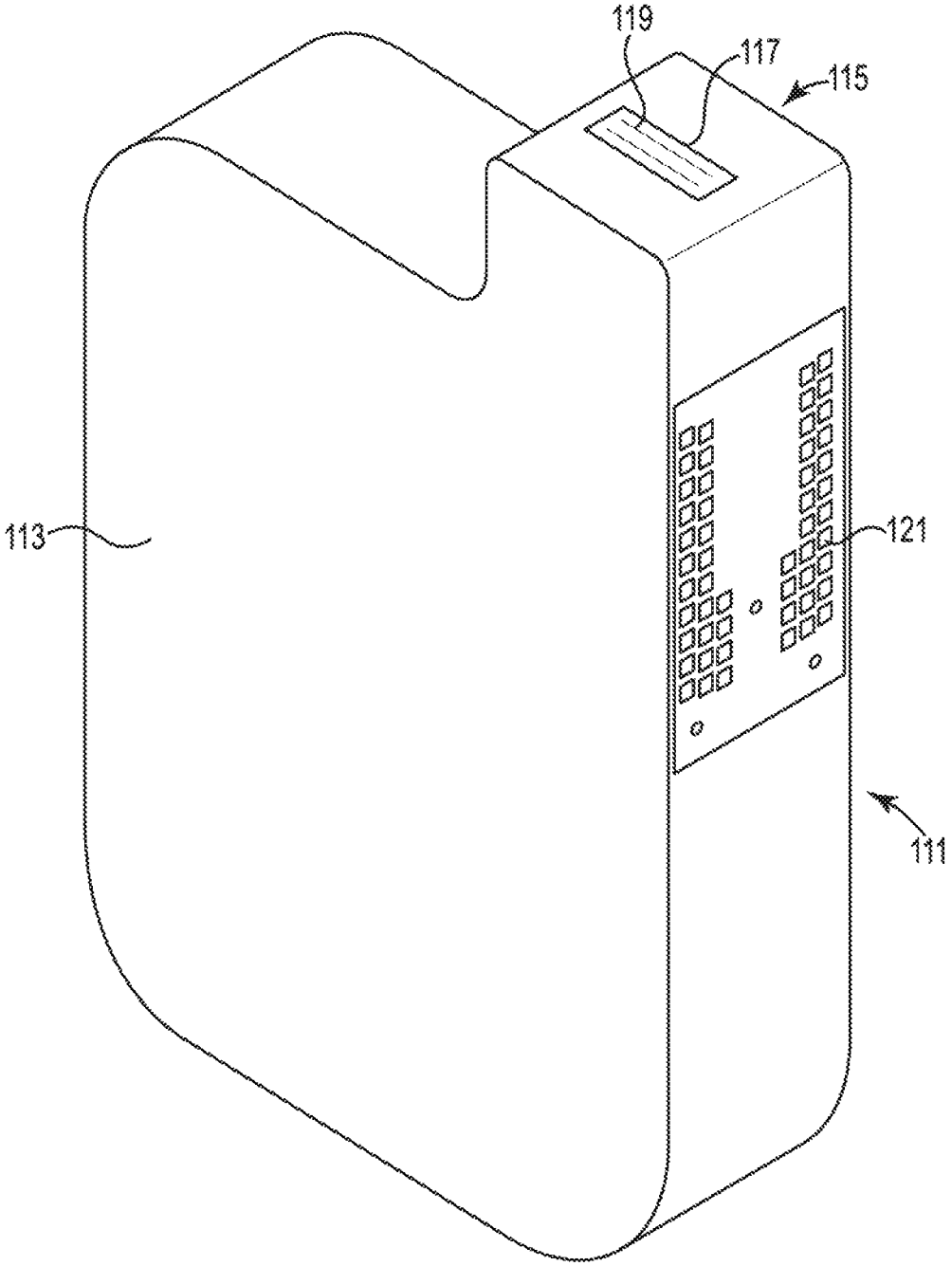
FIG. 1 is a section view illustrating an example of a print cartridge according to the present disclosure.

FIG. 1 is a section view illustrating an example of a print cartridge 111 (e.g., an inkjet print cartridge). A print cartridge can include a component of a printer that contains ink to be deposited onto a medium (e.g., paper) during printing. The print cartridge 111 (e.g., inkjet print cartridge) can incorporate a printhead 115. The print cartridge 111 can include an ink reservoir 113. An ink reservoir can include a container to store ink. The printhead 115 can include a nozzle member 117. The nozzle member can include a number of nozzles 119. The number of nozzles 119 can be arranged in two parallel columns of nozzles. The number of nozzles 119 can be arranged in multiple columns and/or no columns depending on a design of the nozzles. Examples are not limited to column, parallel columns, etc. The nozzles can each be associated with a firing chamber. The number of nozzles 119 can be arranged in a particular order and/or can be fired in a particular order. The print cartridge can include contact pads 121. The contact pads 121 can include a component to connect with a printer by terminating a number of conductive traces. The print cartridge can be designed to connect with a printer through the contact pads 121 that contact printer electrodes to provide externally generated energization signals to the printhead.

The number of nozzles 119 can each be designated by an address. A set of addresses can make up a primitive. For example, a primitive can include six addresses that each designate a nozzle location. A nozzle member 117 can include a number of primitives (as illustrated in FIG. 2). As an example, a nozzle member 117 can include four primitives. As another example, a nozzle member 117 can include six primitives.

FIG. 2 is an illustration of an example of a nozzle member 217 according to the present disclosure. The nozzle member 217 can include an array of ink nozzles 219 (e.g., ink nozzles). A first ink nozzle 231-1 can be in a first primitive (P1) (which includes nozzles P1-A1 231-1 through P1-A6 231-6). The first ink nozzle can be designated as a first address (A1) of the first primitive (P1). The first primitive (P1) can be interdigitated with a second primitive (P2) (which includes nozzles P2-A1 233-1 through P2-A6 233-6). A third primitive (P3) can include three addresses (e.g., nozzles P3-A1 231-7 through P3-A3 231-9). The third primitive can be interdigitated with a fourth primitive (P4). The fourth primitive (P4) can include three addresses (e.g., nozzles P4-A1 233-7 through P4-A3 233-9). While the example includes four numbered primitives, additional numbers of primitives can be in a nozzle member 217 (e.g., P(n-1) including nozzles P(n-1)-A4 P(n-1)-A5 231-M, and P(n-1)-A6 231-N, and P(n) including nozzles P(n)-A4 P(n)-A5 233-M, and P(n)-A6 233-N).

A number of firing chambers can be associated with the number of nozzles P1-A1 231-1 through P(n-1)-A6 231-N and P2-A1 233-1 through P(n)-A6 233-N. The number of firing chambers can include a firing chamber associated with a first address of a first primitive (e.g., associated with nozzle P1-A1 231-1). The number of firing chambers can include a first set of firing chambers associated with one primitive of each of the interdigitated sets of primitives. For example, the first set of firing chambers can be associated with nozzles 231-1 through 231-6. The first set of firing chambers can be associated with a first address of the one primitive of each of the interdigitated sets of primitives. For example, P1 can include A1 (e.g., nozzle P1-A1 231-1) and is one primitive of the interdigitated set of P1 and P2 and includes the first address. Nozzle P3-A1 231-7 can be associated with the first set of firing chambers as it includes a first address of P3 and P3 is one primitive of an interdigitated set of primitives (e.g., P3 and P4).

The number of firing chambers can include a second set of firing chambers associated with a first address of another or a different primitive of each of the interdigitated sets of primitives. For example, nozzle P2-A1 233-1 includes a first address of the other primitive of the interdigitated set of primitive P1 and P2. Nozzle P4-A1 233-7 can be associated with a firing chamber of the second set of firing chambers as nozzle P4-A1 233-7 includes a first address of another or a different primitive of an interdigitated set (e.g., interdigitated set P3 and P4).

The first set of firing chambers associated with a first address of one primitive of each of the interdigitated sets of primitives can be fired before the second set of firing chambers associated with a first address of the other primitive of each of the interdigitated sets of primitives is fired. For example, a firing order can include nozzle P1-A1 231-1, nozzle P3-A1 231-7, nozzle P2-A1 233-1, and nozzle P4-A1 233-7.

The number of firing chambers can include a third set of firing chambers associated with a second address of the one primitive of each of the interdigitated sets of primitives. For example, the third set of firing chambers can be associated with nozzles P1-A2 231-2 and P3-A2 231-8 as both nozzles P1-A2 231-2 and P3-A2 231-8 include a second address and are of a first primitive of an interdigitated set of primitives (e.g., interdigitated set P1 and P2, and interdigitated set P3 and P4). The number of firing chambers can include a fourth set of firing chambers associated with a second address of the other primitive of each of the interdigitated sets of primitives. For example, the fourth set of firing chambers can be associated with nozzles P2-A2 233-2 and P4-A2 233-8. The third set of firing chambers associated with the second address of the one primitive of each of the interdigitated sets of primitives can be fired before a fourth set of firing chambers associated with a second address of the other primitive of each of the interdigitated sets of primitives. For example, a firing order can include firing a firing chamber associated with nozzle P1-A1 231-1 nozzle P3-A1 231-7, nozzle P2-A1 233-1, nozzle P4-A1 233-7, nozzle P1-A2 231-2, nozzle P3-A2 231-8, nozzle P2-A2 233-2, and nozzle P4-A2 233-8.

While in this example four primitives are described, examples are not so limited. The number of primitives can be more and/or fewer than four primitives. Each primitive can be designated with a number. The designated number can be based on an order of firing for each primitive. For example, a first primitive can include an address fired before a second primitive. A first odd number primitive can be interdigitated with a first even number primitive. Each subsequently numbered primitive can be interdigitated with each corresponding odd and even primitive. For example, a fifth and a sixth primitive can be interdigitated, etc.

A nozzle member 217 can include an array of ink nozzles (e.g., nozzles orifices) arranged in a number of primitives. The number of primitives can include a first primitive of the number of primitives interdigitated with a second primitive. The first and second primitive can be interdigitated so that a first address of the first primitive (e.g., nozzle P1-A1 231-1) is in a first-ordered nozzle position and a first address of the second primitive (e.g., nozzle P2-A1 233-1) is in a second-ordered nozzle position. An ordered nozzle position can include a position in a column of a nozzle member. For example, nozzle P1-A1 231-1 is in a first position in the column in FIG. 2. Nozzle P2-A1 233-1 is in a second position in the column, and so forth. The first and second primitive can be interdigitated so that a second address of the first primitive (e.g., nozzle P1-A2 231-2) is in a third-ordered nozzle position and a second address of the second primitive (e.g., nozzle P2-A2 233-2) is in a fourth-ordered nozzle position. The first and second primitives can be interdigitated so that a third, fourth, fifth, and sixth address of the first primitive is in a fifth (e.g., nozzle P1-A3 231-3), seventh (nozzle P1-A4 231-4), ninth (e.g., nozzle Pl-A5 231-5), and eleventh-ordered (e.g., nozzle P1-A6 231-6) nozzle positions.

The number of primitives can include a second primitive that includes a third, fourth, fifth, and sixth address in corresponding sixth (e.g., nozzle P2-A3 233-3), eighth (e.g., nozzle P2-A4 233-4), tenth (e.g., nozzle P2-A5 233-5), and twelfth-ordered (e.g., nozzle P2-A6 233-6) nozzle positions. The nozzle member 217 can include a third primitive of the number of primitives interdigitated with a fourth primitive. The third and fourth primitive can be interdigitated so that a first address of the third primitive is in a thirteenth-ordered nozzle position (e.g., nozzle P3-A1 231-7) and a first address of the fourth primitive is in a fourteenth-ordered nozzle position (e.g., nozzle P4-A1 233-7). The third and fourth primitive can be interdigitated so that a second address of the third primitive is in a fifteenth-ordered nozzle position (e.g., nozzle P3-A2 231-8) and a second address of the fourth primitive is in a sixteenth-ordered nozzle position (e.g., nozzle P4-A2 233-8). The third and fourth primitive can be interdigitated so that a third address is in a corresponding seventeenth-ordered nozzle position (e.g., nozzle P3-A3 231-9). The third and fourth primitive can be interdigitated so that the fourth primitive includes a third address in a corresponding eighteenth-ordered nozzle position (e.g., nozzle P4-A3 233-9).

A delay in firing of the number of firing chambers can include a dual propagation delay. For example, the following chart below can indicate a delay for firing of each firing chamber associated with the nozzles. The delay can be an analog delay. The delay can be in digital master clock increments ("MCLK").

| Primitive & Address | Delay = |
|---|---|
| P1-A1 | 0 |
| P2-A1 | n/2 + 1 |
| P1-A2 | 0 |
| P2-A2 | n/2 + 1 |
| P1-A3 | 0 |
| P2-A3 | n/2 + 1 |
| P1-A4 | 0 |
| P2-A4 | n/2 + 1 |
| P1-A5 | 0 |
| P2-A5 | n/2 + 1 |
| P1-A6 | 0 |
| P2-A6 | n/2 + 1 |
| P3-A1 | 1 |
| P4-A1 | n/2 + 2 |
| P3-A2 | 1 |
| P4-A2 | n/2 + 2 |
| P3-A3 | 1 |
| P4-A3 | n/2 + 2 |
| . . . | |
| P(n − 1)-A4 | n/2 |
| P(n)-A4 | n |
| P(n − 1)-A5 | n/2 |
| P(n)-A5 | n |
| P(n − 1)-A6 | n/2 |
| P(n)-A6 | n |

The value of n in the chart can be equal to the number of primitives in a column. For example, consider a column with four primitives. A first series of firing can include firing the firing chambers associated with four nozzles (e.g., nozzles 231-1, 231-7, 233-1, and 233-7). A firing chamber associated with a first nozzle (e.g., nozzle P1-A1 231-1) can have a delay of 0 and be fired immediately. A firing chamber associated with a second nozzle (e.g., nozzle P3-A1 231-7) can have a firing delay of 1. A firing chamber associated with a third nozzle (e.g., nozzle P2-A1 233-1) can have a firing delay of 3 (e.g., (n=4)/2+1). A firing chamber associated with a fourth nozzle (e.g., nozzle P4-A1 233-7) can have a firing delay of 4 (e.g., ((n=4)/2)+2).

A second series of firing can occur subsequent to the first firing. The second series of firing can include firing the firing chambers associated with four additional nozzles (e.g., nozzles 231-2, 231-8, 233-2, and 233-8). A firing chamber associated with a fifth nozzle (e.g., nozzle P1-A2 231-2) can have a delay of 0 and be fired after the fourth nozzle (e.g., nozzle P4-A1 233-7). A firing chamber associated with a sixth nozzle (e.g., nozzle P3-A2 231-8) can have a delay of 1 in relation to the fifth nozzle firing. A firing chamber associated with a seventh nozzle (e.g., nozzle P2-A2 233-2) can have a delay of 3 (e.g., (n=4)/2+1) in relation to the fifth nozzle firing. A firing chamber associated with an eighth nozzle (e.g., P4-A2 233-8) can have a delay of 4 (e.g., ((n−4)/2)+2) in relation to the fifth nozzle firing.

Figure 3:
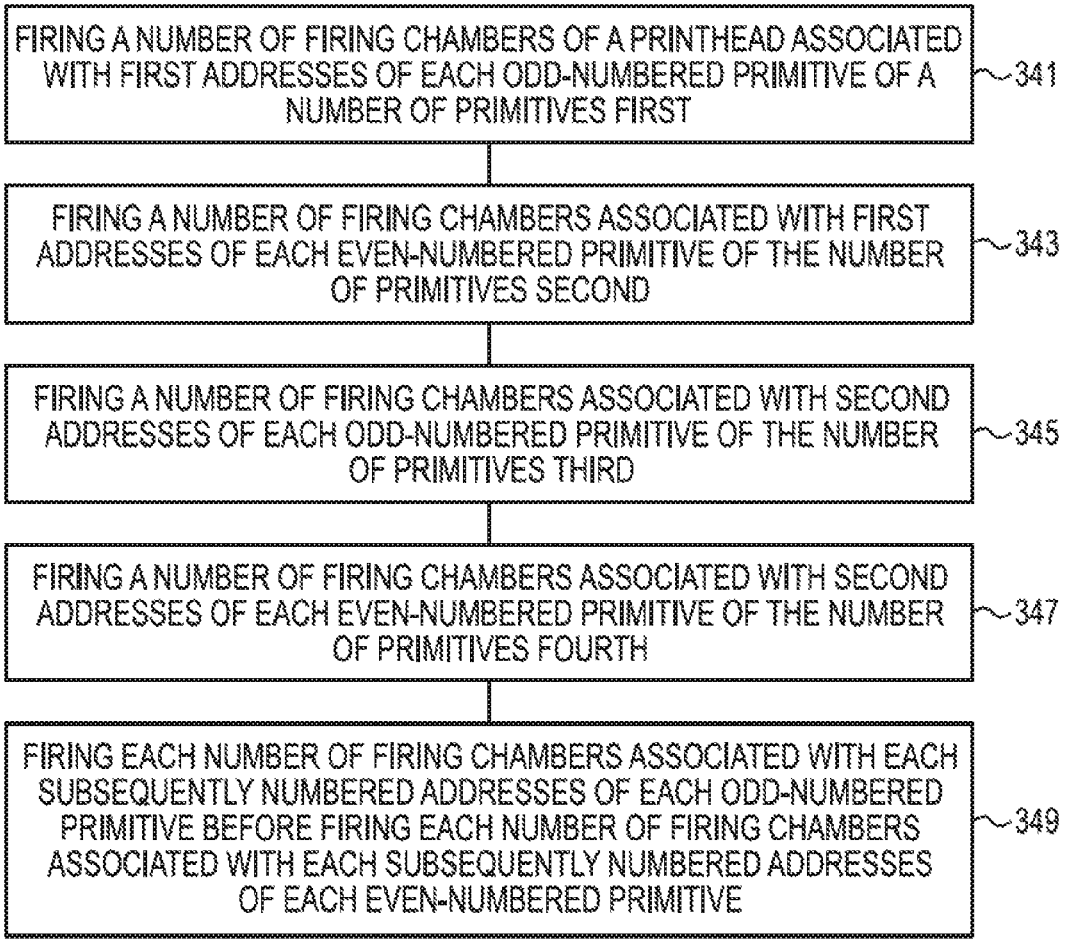
FIG. 3 is are example of a method for printing according to the present disclosure.

FIG. 3 is an example of a method for printing according to the present disclosure. At 341, the method can include firing a number of firing chambers of a printhead associated with first addresses for each odd-numbered primitive of a number of primitives first. The number of primitives can be numbered based on an ordering of firing of the number of primitives. For example, a particular address of a first primitive can be fired before a particular address of a second primitive. Firing can occur by skipping a number of the ordered primitives. For example, a first primitive can be fired before a third primitive, and the third primitive can be fired before a second. Odd-numbered primitives can each be interdigitated with a subsequently ordered even-numbered primitive.

At 343, the method can include firing a number of firing chambers associated with first addresses of each even-numbered primitive of the number of primitives second. For example, a firing chamber associated with a first address of a second primitive (e.g., nozzle 233-1 in FIG. 2) can be fired. A firing chamber associated with a first address of a fourth primitive (e.g., nozzle 233-7 in FIG. 2) can be fired.

At 345, the method can include firing a number of firing chambers associated with second addresses of each odd-numbered primitive of the number of primitives third. For example, a firing chamber associated with a second address of a first primitive (e.g., nozzle 231-2) can be fired. A firing chamber associated with a second address of a third primitive (e.g., nozzle 231-7) can be fired.

At 347, the method can include firing a number of firing chambers associated with second addresses of each even-numbered primitive of the number of primitives fourth. For example, a firing chamber associated with a second address of a second primitive (e.g., nozzle 233-2) can be fired. A firing chamber associated with a second address of a fourth primitive (e.g., nozzle 233-8) can be fired.

At 349, the method can include firing each of a number of firing chambers associated with subsequently numbered addresses of each odd-numbered primitive before firing each of a number of firing chambers associated with subsequently numbered addresses of each even-numbered primitive. For example, firing chambers associated with a third address of a first primitive (e.g., nozzle 231-3) and a third primitive (e.g., nozzle 231-9) can be fired before firing the firing chambers associated with a third address of a second primitive (e.g., nozzle 233-3) and a fourth primitive (e.g., nozzle 233-9). Further, a firing chamber associated with a fourth address of a first primitive (e.g., nozzle 231-4) can be fired before a firing chamber associated with a fourth address of a second primitive (e.g., 233-4); a firing chamber associated with a fifth address of a first primitive (e.g., nozzle 231-5) can be fired before a firing chamber associated with a fifth address of a second primitive (e.g., nozzle 233-5); and a firing chamber associated with a sixth address of a first primitive (e.g., 231-6) can be fired before a firing chamber associated with a sixth address of a second primitive (e.g., nozzle 233-6).

The firing of the number of firing chambers can be executed by a system including a processor executing instructions stored on a non-transitory machine-readable medium. The system can include a data store, resource management system and/or a number of engines. The resource management system can be in communication with the data store via a communication link, and can include engines. The number of engines can include a combination of hardware and programming that is configured to perform a number of functions described herein (e.g. fire a number of firing chambers). The programming can include program instructions (e.g., software, firmware, etc.) stored in a memory resource (e.g., computer readable medium, machine readable medium, etc.) as well as hard-wired program (e.g., logic).

The system to fire a number of firing chambers can utilize software, hardware, firmware, and/or logic to perform a number of functions described herein. The system can be any combination of hardware and program instructions configured to share information. The hardware, for example can include a processing resource and/or a memory resource (e.g., computer-readable medium, machine readable medium (MRM), database, etc.). A processing resource, as used herein, can include any number of processors capable of executing instructions stored by a memory resource. The processing resource may be integrated in a single device or distributed across multiple devices. The program instructions (e.g., computer-readable instructions (CRI)) can include instructions stored on the memory resource and executable by the processing resource to implement a desired function (e.g., fire a number of firing chambers).

The memory resource can be in communication with a processing resource. A memory resource, as used herein, can include any number of memory components capable of storing instructions that can he executed by processing resource. Such a memory resource can be a non-transitory CRM or MRM. Computer-readable medium may be integrated in a single device or distributed across multiple devices. Further, memory resource may be fully or partially integrated in the same device as processing resource or it may be separate but accessible to that device and processing resource. Thus, it is noted that the system may be implemented on a participant device, on a server device, on a collection of server devices, and/or a combination of the user device and the server device.

The memory resource can be in communication with the processing resource via a communication link (e.g., a path). The communication link can be local or remote to a machine (e.g., a computing device) associated with the processing resource. Examples of a local communication link can include an electronic bus internal to a machine (e.g., a computing device) where the memory resource is one of volatile, non-volatile, fixed, and/or removable storage medium in communication with the processing resource via the electronic bus.

A number of modules can include CRI that when executed by the processing resource can perform a number of functions. The number of modules can be sub-modules of other modules. For example, the historical comparison module and the neighbor comparison module can be sub-modules and/or contained within the same computing device. In another example, the number of modules can comprise individual modules at separate and distinct locations (e.g., CRM, etc.). Each of the number of modules can include instructions that when executed by the processing resource can function as a corresponding engine.

The specification examples provide a description of the applications and use of the system and method of the present disclosure. Since many examples can be made without departing from the spirit and scope of the system and method of the present disclosure, this specification sets forth some of the many possible example configurations and implementations. With regard to the figures, the same part numbers designate the same or similar parts throughout the figures. The figures are not necessarily to scale. The relative size of some parts is exaggerated to more clearly illustrate the example shown.

What is claimed:

1. A printing system comprising:

a processor; and a non-transitory storage medium storing instructions executable on the processor to:

control firing of a number of firing chambers of a printhead associated with first addresses of each odd-numbered primitive of a number of primitives first, wherein the number of primitives are numbered based on an ordering of firing of the number of primitives and each odd numbered primitive is interdigitated with a subsequently ordered even-numbered primitive;

control firing of a number of firing chambers associated with first addresses of each even-numbered primitive of the number of primitives second;

control firing of a number of firing chambers associated with second addresses of each odd-numbered primitive of the number of primitives third; and control firing of a number of firing chambers associated with second addresses of each even-numbered primitive of the number of primitives fourth.

2. The printing system of claim 1, wherein the instructions are executable on the processor to control firing each of a number of firing chambers associated with subsequently numbered addresses of each odd-numbered primitive before firing each of a number of firing chambers associated with subsequently numbered addresses of each even-numbered primitive.

3. The printing system of claim 1, wherein the instructions are executable on the processor to control firing each primitive sequentially down a column with a fire pulse delay causing the firing of the first address of a first primitive to fire one delay unit before the first address of a third primitive.

4. The printing system of claim 1, wherein each of the first addresses designates a respective nozzle of an array of nozzles of the printhead, and each of the second addresses designates a respective nozzle of the array of nozzles.

5. A method for printing, comprising:

firing a number of firing chambers of a printhead associated with first addresses of each odd-numbered primitive of a number of primitives first, wherein the number of primitives are numbered based on an ordering of firing of the number of primitives and each odd numbered primitive is interdigitated with a subsequently ordered even-numbered primitive;

firing a number of firing chambers associated with first addresses of each even-numbered primitive of the number of primitives second;

firing a number of firing chambers associated with second addresses of each odd-numbered primitive of the number of primitives third; and firing a number of firing chambers associated with second addresses of each even-numbered primitive of the number of primitives fourth.

6. The method of claim 5, comprising firing each of a number of firing chambers associated with subsequently numbered addresses of each odd-numbered primitive before firing each of a number of firing chambers associated with subsequently numbered addresses of each even-numbered primitive.

7. The method of claim 5, wherein an order of the firing of each of the number of firing chambers is controlled by instructions executed by a processor that are stored on a non-transitory computer-readable medium.

8. The method of claim 5, comprising firing each primitive sequentially down a column with a fire pulse delay causing the firing of the first address of a first primitive to fire one delay unit before the first address of a third primitive.

* * * * *